US006134811A

United States Patent [19]

Berger et al.

[11] Patent Number: 6,134,811

[45] Date of Patent: Oct. 24, 2000

[54] DEVICE FOR REMOVING LIQUID FROM THE SURFACE OF A BAND

[75] Inventors: Bernd Berger, Kaarst; Manfred Benfer, Menden; Heiko Peche, Gevelsberg, all of Germany

[73] Assignee: Sundwig GmbH, Hemer, Germany

[21] Appl. No.: 09/202,987

[22] PCT Filed: Jun. 24, 1996

[86] PCT No.: PCT/EP96/02740

§ 371 Date: Feb. 18, 1999

§ 102(e) Date: Feb. 18, 1999

[87] PCT Pub. No.: WO97/49507

PCT Pub. Date: Dec. 31, 1997

[51] Int. Cl.[7] ..... F26B 9/00

[52] U.S. Cl. ..... 34/618; 34/635; 34/639; 34/643

[58] Field of Search ..... 34/71, 95, 618, 34/629, 635, 639, 643; 72/17.1, 19.8, 229, 205; 226/95, 97

[56] References Cited

U.S. PATENT DOCUMENTS

| | | | |
|---|---|---|---|
| 3,041,739 | 7/1962 | Meier-Windhorst | 34/643 |
| 3,192,752 | 7/1965 | Dowd et al. . | |
| 3,607,366 | 9/1971 | Kurokawa . | |
| 4,094,077 | 6/1978 | Schrader et al. | 34/639 |
| 4,400,961 | 8/1983 | Schaming . | |
| 4,601,112 | 7/1986 | Kush et al. . | |
| 4,750,715 | 6/1988 | Harada et al. | 34/643 X |
| 4,833,794 | 5/1989 | Stibbe et al. | 34/643 |
| 4,989,346 | 2/1991 | Wilken | 34/71 |
| 5,588,223 | 12/1996 | Marshall | 34/635 X |
| 5,752,641 | 5/1998 | Klas et al. | 34/643 X |
| 5,758,520 | 6/1998 | Hirano et al. | 34/643 X |

FOREIGN PATENT DOCUMENTS

| | | |
|---|---|---|
| 42 15 602 | 11/1992 | Germany . |
| 43 05 907 | 8/1994 | Germany . |
| 195 19 544 | 11/1996 | Germany . |
| 62-124015 | 6/1987 | Japan . |
| 2 111 885 | 7/1983 | United Kingdom . |
| WO 96 07490 | 3/1996 | WIPO . |

*Primary Examiner*—Stephen Gravini
*Attorney, Agent, or Firm*—Proskauer Rose LLP

[57] ABSTRACT

The invention provides an apparatus for the removal of liquid from the surface (0', 0") of a strip (B) conveyed from a strip processing machine, more particularly a rolling stand, by means of a gas jet (G1, G4, G5, Gzl, Gzr, G12–G18, G17', G18'), which has an outlet nozzle (2, 4, 5, 12–19) from which the gas jet (G1, G4, G5, Gzl, Gzr, G12–G18, G17', G18') emerges, and a suction opening (8*a*), via which the gas jet (G1, G4, G5, Gzl, Gzr, G12–G18, G17', G18') can be removed by suction mixed with the liquid, the apparatus enabling the surface of the strip to be adequately cleaned over its whole width. This is achieved by the feature that the gas jet (G1, G4, G5, Gzl, Gzr, G12–G18, G17', G18') is guided over the strip (B) in a flow (S, S2) directed towards at least one of the lateral edges (R) of the strip (B), and a suction opening (8*a*) is associated with that lateral edge (R) of the strip (B) at which the flow (S, S2) is directed.

8 Claims, 6 Drawing Sheets

DEVICE FOR REMOVING LIQUID FROM THE SURFACE OF A BAND

BACKGROUND OF THE INVENTION

The invention relates to a an apparatus for removing liquids from the surface of a strip conveyed from a strip processing machine, more particularly a rolling stand, by means of a gas jet, having an outlet nozzle, from which the gas jet emerges, and a suctional opening, via which the gas jet can be removed by suction mixed with the liquid.

Apparatuses of the kind specified are needed to remove residues of lubricant, more particularly from high-speed rolled metal strips. After the rolling operation residues of the lubricant remain adhering to the strip, to which they were applied during rolling. If the lubricant liquid is inadequately removed, after the strip has been wound into a coil, the lubricant residues form between its individual windings a film which may cause the individual windings of the coil to telescope—i.e. become displaced axially of the reel during reeling. Moreover, as a rule the further processing of the strips requires very low residual quantities of lubricant, referred to the surface of the rolled strip.

For a considerable period attempts have been made to remove, for example, by air blasts, residues remaining on the ship after its treatment. For example, U.S. Pat. No. 3 607 366 discloses an apparatus of the art mentioned above wherein slot jet nozzles extending substantially over the width of the strip are adjusted to a predetermined inclination of their jets against the direction in which the strip to be cleaned travels. The gas jet emerging from the nozzles is directed substantially against the conveying direction of the strip. Practical tests of such apparatuses for removing residues from strips have shown that the cleaning effect achievable by said apparatuses is inadequate to completely remove residues of lubricant left on strips after each rolling operation, more particularly on strips processed on rolling stands.

An improved apparatus for the removal of liquids from the surface of a strip is disclosed in German Offenlegungsschrift DE 42 15 602 A1. In that apparatus the gas jet is blown, also via a slot jet nozzle disposed at a predetermined angle of inclination transversely of the direction in which the strip travels, on to the strip against its conveying direction, the relation between the width of the slot jet nozzle and its distance from the strip being so selected that the gas jet impinges on the strip at high velocity. At the same time, disposed at a predetermined distance in the strip conveying direction upstream of the slot jet nozzle in this prior art apparatus is a suctional removal gap via which the gas flow and the liquid mixed therewith is removed from the strip by suction.

Use in practice of the apparatus known from DE 42 15 602 A1 has shown that an adequate cleaning effect can be achieved thereby in the zone of the centre of the strip. However, it was also found that the cleaning effect is frequently inadequate in the zone of the strip longitudinal edges, the place where particularly large residues of liquid often collect.

It is an object of the invention so to improve an apparatus of the kind specified that it enables a sufficient cleaning of the strip surface to be achieved over its whole width.

This problem is solved according to the invention by the feature that in an apparatus of the kind specified the gas jet is guided over the strip in a flow directed in the direction of at least one of the lateral edges of the strip and that a suction opening is associated with that lateral edge of the strip at which the flow is directed.

According to the invention the gas jet for cleaning the surface of the strip is not blown onto the strip in a flow directed substantially against the strip conveying direction any more, as done by the apparatus of the prior art, but a lateral flow can be additionally produced which is directed at one or both of the lateral edges of the strip. The suctional removal opening is disposed laterally of the strip, so that the mixture of gas and liquid can be removed immediately alongside the strip. In this way a large volumetric flow of gas can be taken over the strip at high flow velocity. The mass impulse of the high volumetric flow is enough to remove even fairly large quantities of liquid from the surface of the strip to be cleaned and more particularly from its marginal zones.

SUMMARY OF THE INVENTION

It is advantageous for the creation of volumetric flows which are as large as possible and which at the same time are directed over the width of the strip in a concentrated volumetric flow over the strip, if the apparatus according to the invention is furnished with at least two outlet nozzles arranged in pairs, which lie opposite each other in the conveying direction of the strip. With such an arrangement of the outlet nozzles it can be achieved that the individual gas jets emerging from the nozzles unite in a volumetric flow which can pass on a particularly high mass impulse/a particularly high kinetic energy. At the same time, eddying takes place in the zone in which the gas jets are mixed with one another. The eddying encourages the atomization of the liquid adhering to the strip surface. The mixing of the gas jets emerging from at least two outlet nozzles can be boosted by the feature that at least one component flow of the gas jet emerging from each of the outlet nozzles is directed against that gas jet which emerges from each opposite outlet nozzle.

Since a large volumetric flow is required more particularly in the marginal zone of the strip for the removal of the liquid adhering thereto at that place, it makes sense for the apparatus according to the invention to be furnished with a plurality of outlet nozzles disposed one beside the other in series over the width of the strip. In that case the volumetric flow of gas increases in the direction of the lateral edge of the strip, due to the fact that an additional component flow from each of the outlet nozzles is added to said volumetric flow. The outlet nozzles can be so arranged as to give an optimum adaptation of the increase in volumetric flow over strip width to the conditions created by the collection of liquid. Another advantage of the arrangement of outlet nozzles one beside the other in series is that a certain number of nozzles can be so directed that the gas jet emerging therefrom is blown on to the strip immediately into the direction of its lateral edge, while a certain number of the remaining nozzles are aligned, for example, in or against the conveying direction of the strip. The result of the gas jet flows then impinging on one another in different directions is that the gas jets unite with increased eddying to give a concentrated flow of high kinetic energy. A favorable development of flow can also be achieved by combining with one another rows of differently directed nozzles.

As an alternative to the use of a plurality of outlet nozzles disposed one beside the other in series, the outlet nozzle can also take the form of a flat jet nozzle. With the use of such a flat jet nozzle the volumetric flow increases, for example, linearly in the direction of the lateral edge of the strip, starting at the strip center. The gas jet emerging from the flat jet nozzle can be so directed against the strip that if two oppositely disposed flat jet nozzles are used, the gas jets emerging therefrom unite in a volumetric flow which also has a high kinetic energy.

Alternatively or in addition to a particular direction of the outlet nozzles, in the zone of the outlet nozzles at least one deflecting device can be disposed for the deflection of the gas jet in the required direction. This also favors the formation of a concentrated volumetric flow and the optimum atomization of the liquid adhering to the strip surface with the gas flow.

In such cases, in which the quantities of liquid collecting in the marginal zones of the strip are approximately equal, advantageously a component flow of the gas jet emerging from the outlet nozzle is guided in the direction of one lateral edge of the strip, while the other component flow is guided in the direction of the other edge of the strip, and at the same time a suctional removal opening is associated with each of the two edges of the strip. In this way, if collections of liquid occur on both sides, the strip surface can be freed from liquid adhering thereto uniformly over its whole width.

To boost the lateral flow of the gas jet, the gas jet can also be supplied directly to the discharge channel constructed between the outlet nozzles. This can be put into effect, for example, by the feature that disposed between the outlet nozzles is at least one further outlet nozzle which is positioned more particularly centrally between the lateral edges of the strip and via which a gas jet directed substantially transversely of the conveying direction impinges on the strip surface.

The versatility of the apparatus according to the invention can also be enhanced by the outlet nozzles being constructed in a nozzle body which is releasably retained in a recess in a casing element and, alternatively to the nozzle body, a seal support can be inserted in the recess which can moved therein substantially vertically in relation to the surface of the strip and which bears a stripper seal and can be acted upon by the pressure of the gas jet. If at least two such nozzles are used, in dependence on the particular application it may also be advantageous to combine an outlet nozzle with a corresponding stripper seal.

BRIEF DESCRIPTION OF THE DRAWINGS

The invention will now be explained in greater detail with reference to the drawings, which illustrate an embodiment thereof and which show.

DETAILED DESCRIPTION OF THE INVENTION

Figure 1:
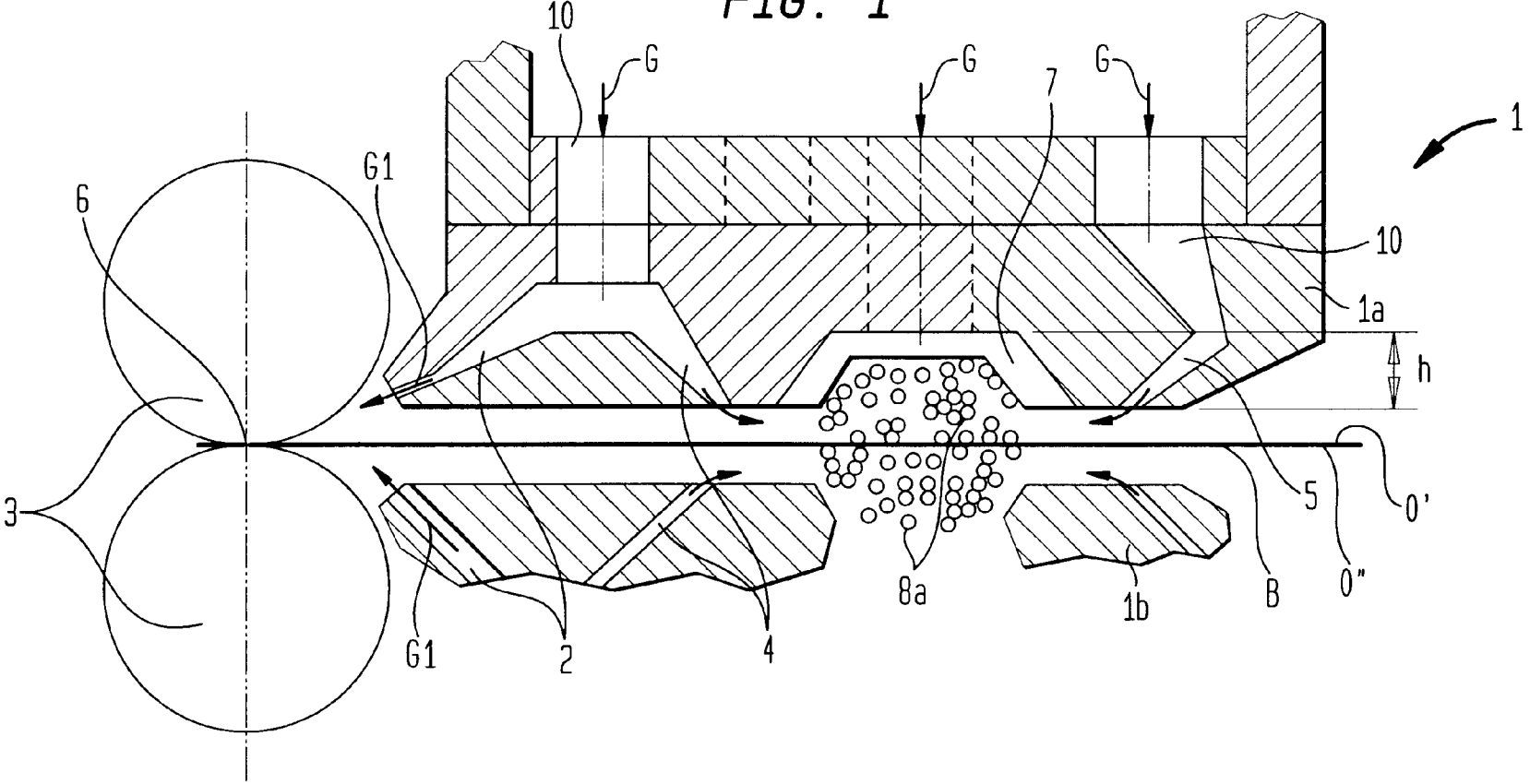
FIG. 1 a longitudinally sectioned view of part of an apparatus for removing liquid from the surface of a strip, FIG. 2 a cross-sectional view of part of the apparatus shown in FIG. 1, FIG. 3 a horizontally sectioned view of part of the apparatus shown in FIGS. 1 or 2, FIG. 4*a* an enlarged detail A of FIG. 3, FIG. 4*b* a detail, corresponding to detail A in FIG. 3, of an alternative embodiment of the apparatuses illustrated in FIGS. 1–4*a*, FIG. 5*a, b, c* each a view, corresponding to detail A in FIG. 3, of further alternative embodiments of the apparatuses illustrated in FIGS. 1 to 4*b* and FIG. 6 a view to an enlarged scale, corresponding to FIG. 1, of another alternative embodiment of the apparatuses illustrated in FIG. 1.
Figure 2:
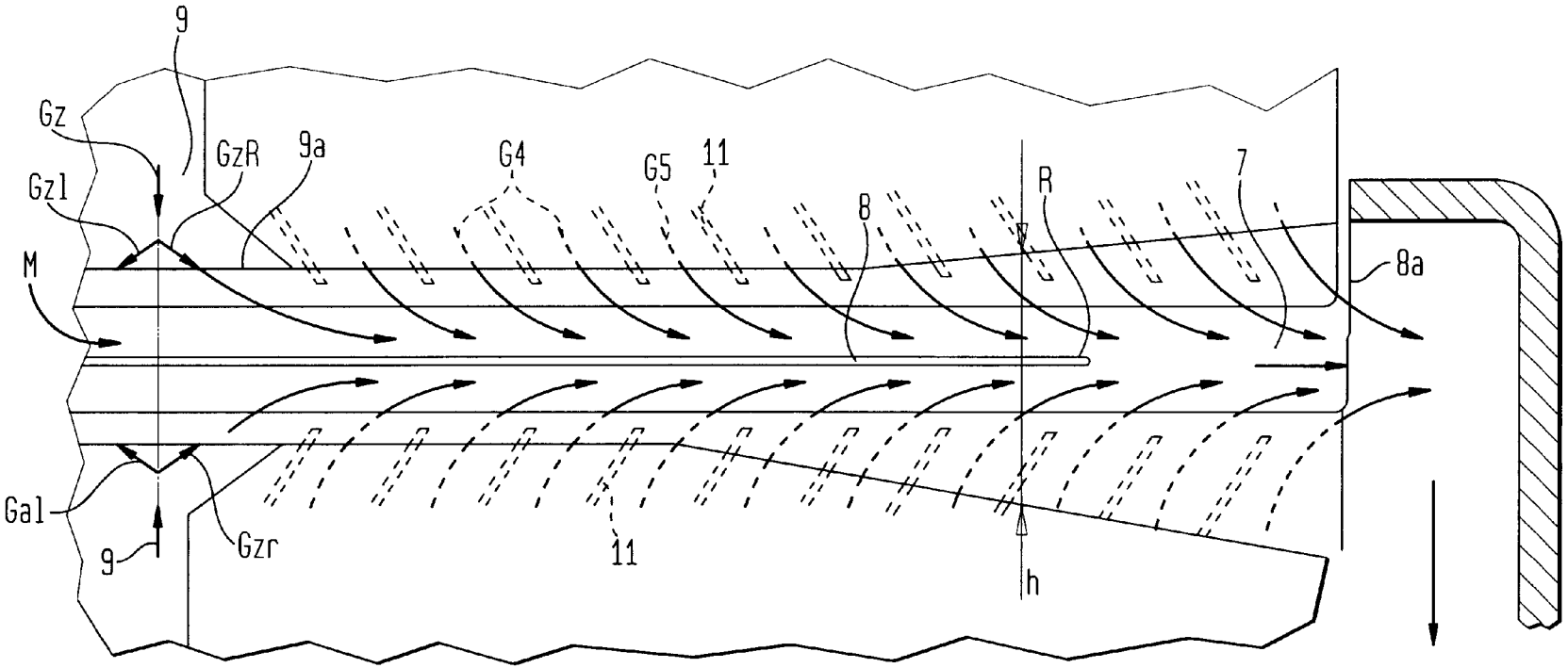
Figure 3:
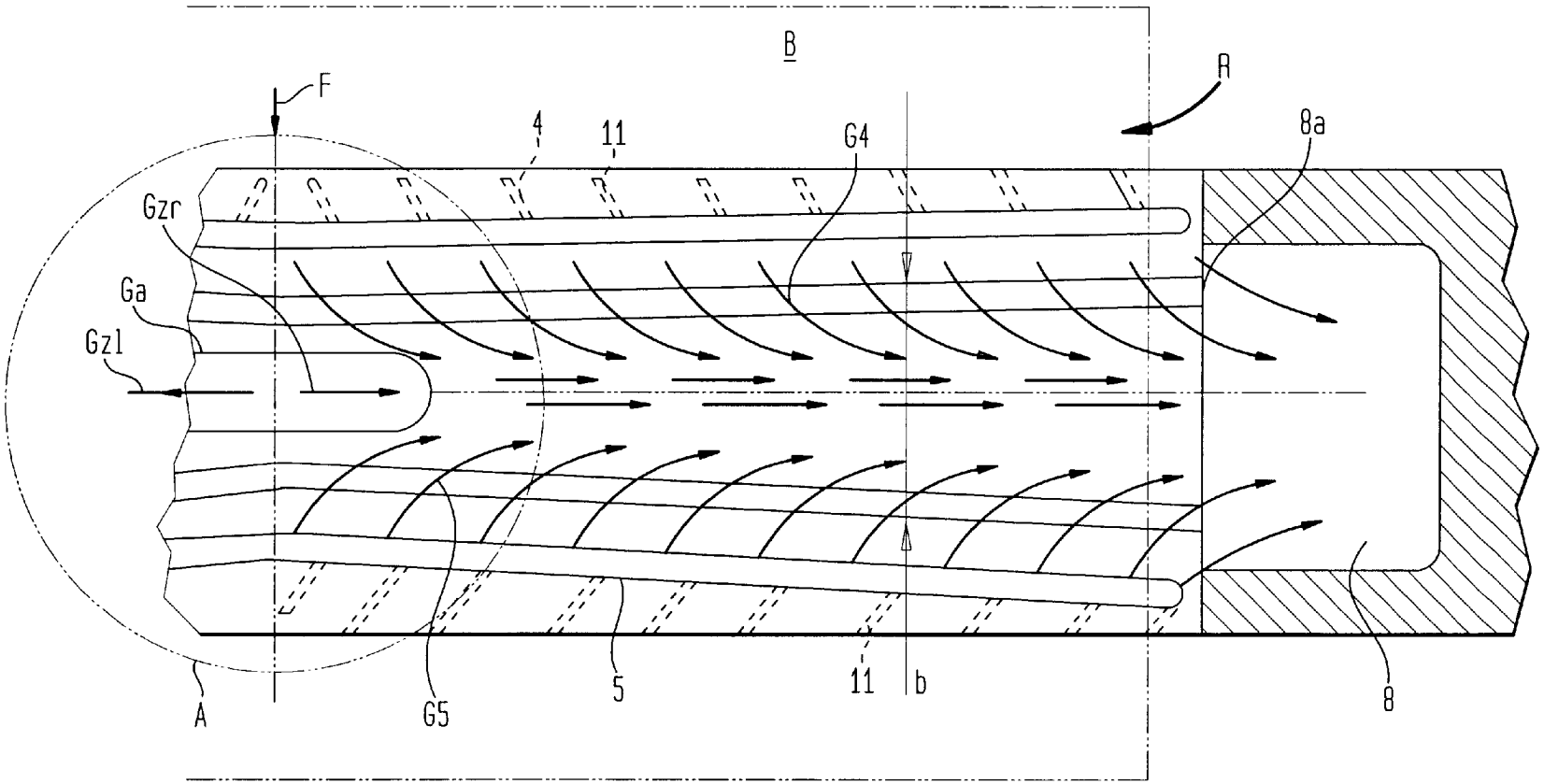

The apparatus according to the invention for removing liquid from the top and bottom surfaces 0', 0" of a strip B conveyed from a rolling stand (not shown) has a casing 1 whose halves 1*a*, 1*b* are constructed laterally inverted in relation to the strip B, the upper casing half 1*a* being associated with the upper strip surface 0' and the lower half 1*b* being associated with the lower strip surface 0".

The casing halves 1*a*, 1*b* project laterally beyond the edges R of the strip B. They each have a first outlet nozzle 2 each associated with a pinch roller 3 disposed above and below the strip B respectively upstream of the casing halves 1*a*, 1*b* in the conveying direction F of the strip.

A second outlet nozzle 4 is constructed in each of the casing halves 1*a*, 1*b* spaced out from the first outlet nozzle 2 in the conveying direction F. A third outlet nozzle 5 is disposed in the marginal zone of the casing halves 1*a*, 1*b* remote from the pinch rollers 3.

In the embodiment illustrated in FIGS. 1, 2, 3 and 4*a* each of the outlet nozzles 2, 4, 5 takes the form of a flat jet nozzle extending over the width of the particular casing half 1*a*, 1*b*. Each of the flat jet nozzles 2 is so directed towards the pinch rollers 3 that any liquid adhering to the strip surfaces 0', 0" is blown into a pinch nip 6 by a gas jet G1, for example, an air jet, emerging from the outlet nozzles 2. In this way a first proportion of the liquid adhering to the strip surfaces 0', 0" is driven from said surfaces 0', 0" to the edges R of the strip B. The gas jet G1 acts outside the edge zones on the strip surfaces 0', 0" as a barrier jet for the liquid, directed towards the pinch nip 6. The second flat jet nozzle 4 is directed in the conveying direction F of the strip B, while the third flat jet nozzle 5 is directed against the conveying direction F.

In the gap between the flat jet nozzles 4, 5 a channel 7 is formed in the surface of the casing half 1*a*, 1*b* associated with the particular strip surface 0', 0". The channel 7 extends transversely of the conveying direction F of the strip B over the width of the casing halves 1*a*, 1*b*. The channel is symmetrical in structure in relation to the center M of the strip B and has in the zone of the strip center M a height h and width b increasing in the direction of the particular edge R of the strip B, to remove the volumetric flow of gas, which progressively increases in the direction of the edges R of the strip B.

Rows of correspondingly directed round jet nozzles can be used as an alternative to the aforementioned flat jet nozzles 2, 4, 5.

Disposed laterally of the strip B at the end of the channel 7 is in each case a suctional removal opening 8*a* of a suctional removal channel 8 which is connected to a suctional removal system (not shown).

An outlet nozzle 9 is constructed in each of the casing halves 1*a*, 1*b* in the zone of the strip center M and centrally between the outlet nozzles 4, 5. The additional outlet nozzle 9 has a substantially groove-shaped outlet opening 9*a* which widens after the fashion of a funnel in the direction of a strip and whose longitudinal axis extends transversely of the conveying direction F of the strip B. In this way the gas jet Gz emerging pressurized from the outlet nozzle 9 flows in two component flows Gzl and Gzr directly to the left-hand and right-hand edge R of the strip B respectively.

The outlet nozzles 2, 4, 5, 9 are connected via connecting channels 10 to a central gas supply system (not shown) via which the gas flow G is fed pressurized into the connecting channels 10.

Deflecting devices 11 disposed in the zone of the outlet openings of the outlet nozzles 2, 4, 5 ensure that the gas jet G4, G5 emerging from the respective outlet nozzle 4, 5 is directed at an acute angle against the particular edge R of the strip B and at the same time against the gas jet G5, G4 emerging from the particular opposite outlet nozzle 5, 4. The particular gas jet G4, G5 is so directed that in each case it is operative at a different place on the strip B from that of the other gas jet G5, G4. This ensures that the gas jets G4, G5 become mixed with one another with strong eddying and atomization of the liquid collected on the strip B and together form a lateral flow S in the direction of the particular edge R of the strip B, by which the liquid collected on the strip B is entrained.

The formation of the lateral flow S is encouraged by the gas flows Gzl; Gzr, which are directed immediately at the particular lateral edges R. At the same time the removal of the larger collections of fluid in the zone of the particular edges R of the strip B is further boosted by the feature that the quantity of flowing gas increases in the direction of the edge R.

Figure 4A:
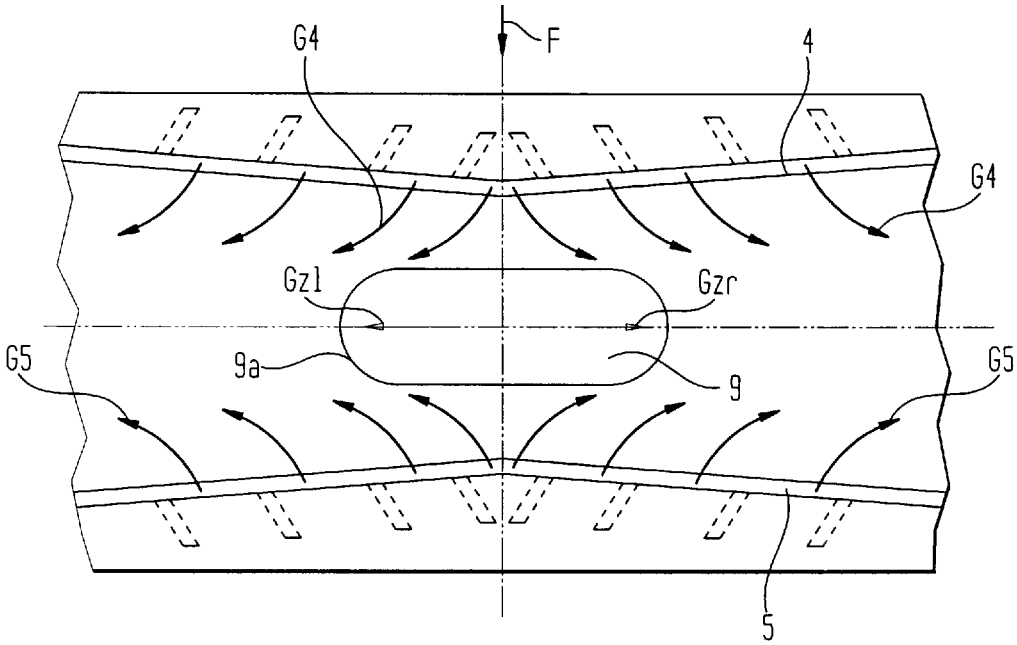
Figure 4B:
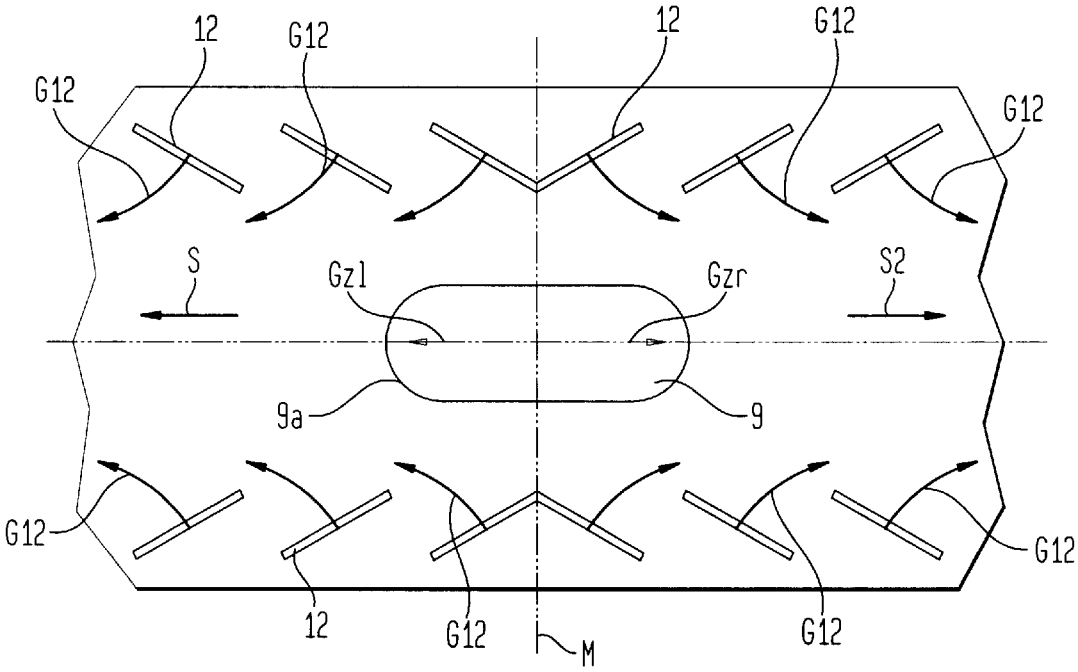

The embodiment illustrated in FIG. 4*b* differs from the one explained hereinbefore by the feature that instead of outlet nozzles 4, 5, each constructed in the form of flat jet nozzles, a plurality of slot nozzles 12 are used which are directed at an angle towards a particular edge R and are disposed one beside the other in series symmetrically of the center M of the strip B. The width of the outlet openings of the slot nozzles 12 is relatively small. The direction of the slot nozzles 12 ensures that each gas jet G12 emerging therefrom impinges on the gas jets G12 emerging from each opposite slot nozzle and unites with said jets to form a lateral flow S2, accompanied by eddying and entrainment of the liquid adhering to the strip. The formation of the lateral flow S2 is also boosted by the gas jets Gzl and Gzr which emerge from the centrally placed additional outlet nozzle 9.

Figure 5A:
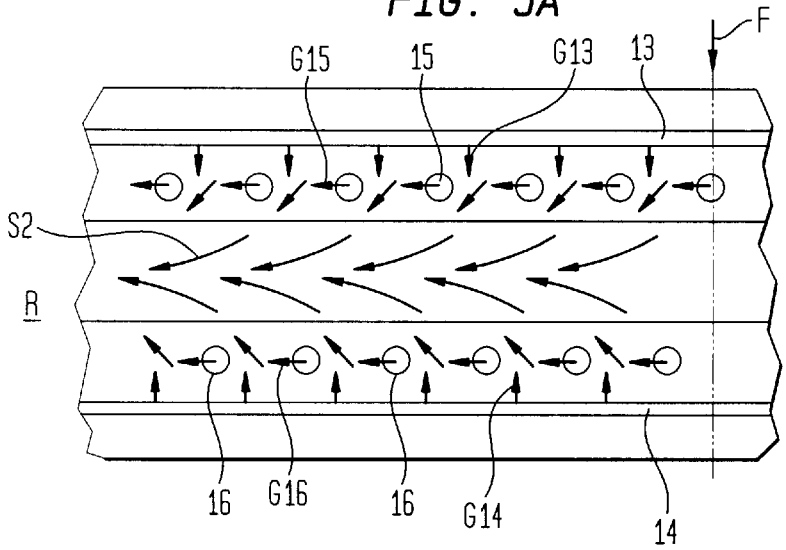

In the embodiment illustrated in FIG. 5*a*, a gas jet G13 flows from a first slot jet nozzle 13, extending at least over the width of the strip B, on to the strip B in a flow directed in the conveying direction F thereof. At the same time, a gas jet G14 directed against the conveying direction F flows from a slot jet nozzle 14 disposed at a distance from the slot jet nozzle 13 in the conveying direction F. Disposed in the gap between the slot jet nozzles 13, 14 are jet nozzles 15, 16, from each of which there emerges a gas jet G15, G16 directed immediately at the particular edge R. Due to the different mass impulses of the individual flows, the gas jets G15, G16 become mixed, accompanied by eddy formation, with the gas jets G13, G14 emerging from the slot nozzles 13, 14 to form a lateral flow S2 directed against the particular edge R.

Figure 5B:
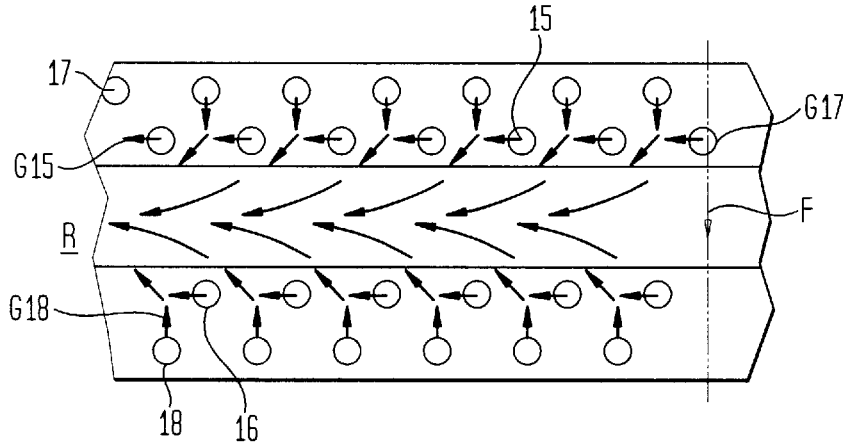

In the embodiment illustrated in FIG. 5*b*, instead of the slot jet nozzles shown in FIG. 5*a* a plurality of jet nozzles 17, 18 are disposed one beside the other in series. The gas jet G17, G18 emerging therefrom is again directed towards/against the conveying direction F over the strip B and also becomes mixed with the gas jets G15, G16 emerging from the jet nozzles 15, 16 to form a lateral flow.

Figure 5C:
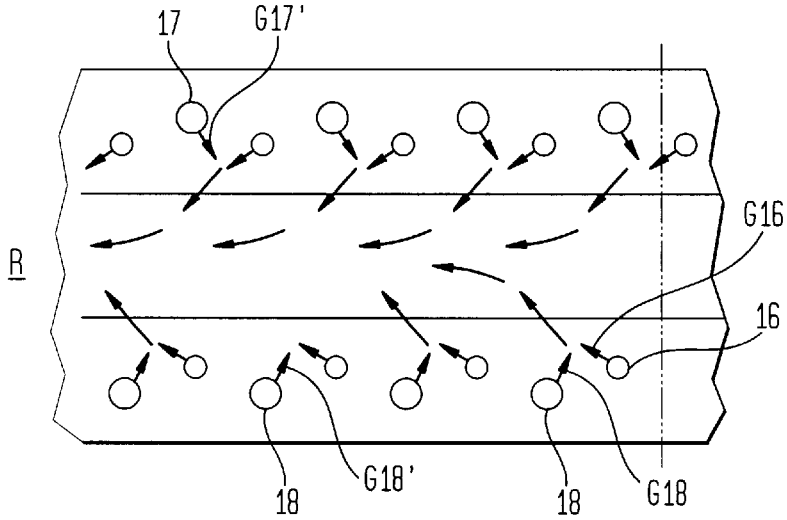

In distinction from the embodiment illustrated in FIG. 5*b*, in the embodiment illustrated in FIG. 5*c*, the gas jets G17', G18' emerging from the jet nozzles 17, 18 are not immediately directed towards/against the conveying direction F of the strip B. Instead, the gas jets G17', G18" emerge from the jet nozzles G17, G18 in a flow directed at the particular other edge R and at the same time impinge on the gas jets G15, G16 directed against the particular most closely adjacent edge R. This leads to an even stronger eddy formation, which again boosts the atomization of liquid collected on the strip.

Figure 6:
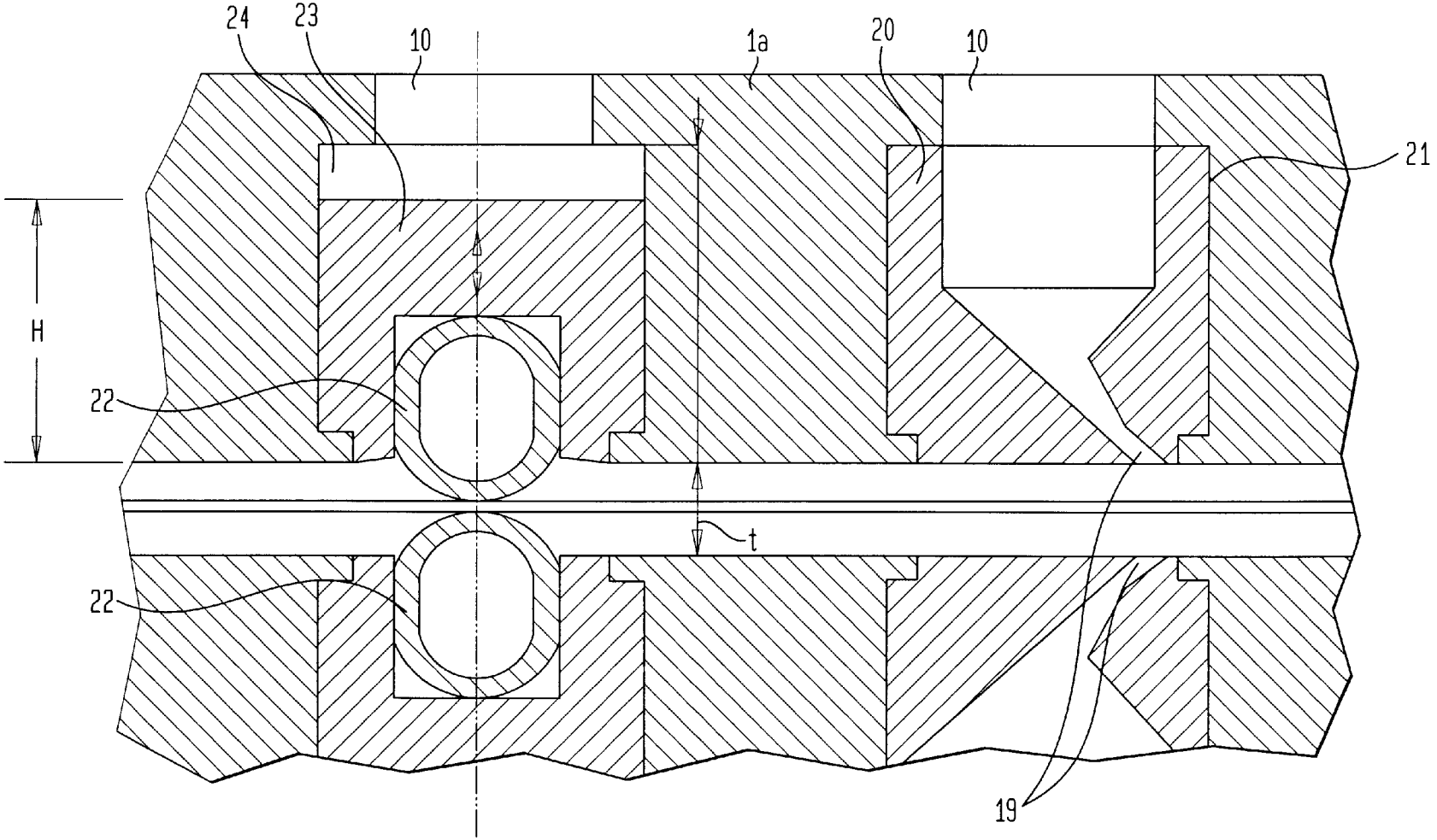

Lastly in the embodiment illustrated in FIG. 6, the outlet nozzle 19 corresponding to the outlet nozzle 4 shown in FIG. 4 is constructed in a nozzle body 20. The nozzle body 20 is inserted into a rail-like recess 21 extending over the width of the particular casing half 1*a*, 1*b* and is releasably retained therein. Moreover, in the embodiment shown in FIG. 6, instead of the outlet nozzle 2 shown in FIG. 1, a lip stripper 22 is provided which is borne by a sealing member 23. The sealing member 23 is also releasably retained in a recess 24 in the particular casing half, so that if necessary it can be exchanged for a nozzle body constructed after the fashion of the nozzle body 20. The sealing member 24 has a height H smaller than the depth T of the recess, so that the sealing member 24 can move in the recess 24, guided by its side walls. At the same time the sealing member 23 is acted upon by the pressure of the gas present in the connecting line 10. This ensures that the lip stripper seal 21 always bears against the strip B with the necessary contact pressure and is also able to yield resiliently with strip unevenesses. The adjustability in height of the sealing member 23 also enables damage to the lip stripper 22 to be avoided when a fresh strip B is introduced.

What is claimed is:

1. An apparatus for removing liquids from the surface of a strip conveyed from a strip processing machine by means of gas jets, comprising:

first and second outlet nozzles disposed opposite to each other in a conveying direction of said strip and from which said gas jets emerge and form component flows, at least one suctional removal opening for removing by suction said component flows of said gas jets mixed with said liquid to be removed from said strip surface, wherein said gas jets are guided over said strip in a flow directed towards at least one of the lateral edges of said strip, said at least one suctional removal opening being located in proximity to said lateral edge toward which said flow is directed, and wherein at least one said component flow of said gas jet emerging from said first outlet nozzle is directed towards said gas jet emerging from said second outlet nozzle.

2. The apparatus of claim 1, further comprising a plurality of pairs of said first and second outlet nozzles disposed in series along said conveying direction of said strip.

3. The apparatus of claim 2, wherein said pairs of said first and second outlet nozzles are located above and below said strip.

4. The apparatus of claim 1, wherein said outlet nozzles are flat jet nozzles.

5. The apparatus of claim 1, wherein each of said outlet nozzles has associated with it at least one additional outlet nozzle from which a gas jet emerges in a direction different from that of said gas jets emerging from said first and second outlet nozzles.

6. The apparatus of claim 1, further comprising at least one deflecting device disposed in proximity to said first and second outlet nozzles to deflect the gas jets emerging from said first and second outlet nozzles.

7. The apparatus of claim 1, wherein one of said component flows is guided in the direction of one of said lateral edges of said strip and a second of said component flows is guided in the direction of other of said lateral edges of said strip.

8. The apparatus of claim 1, further comprising an additional outlet nozzle disposed between said first and second outlet nozzles and positioned centrally between said lateral edges of said strip, an additional gas jet emerging from said additional outlet nozzle which is directed substantially transversely to said conveying direction and impinges on said surface of said strip.

* * * * *